US010329068B2

(12) United States Patent
Benford

(10) Patent No.: US 10,329,068 B2
(45) Date of Patent: Jun. 25, 2019

(54) FLAVORING MECHANISM FOR A TOBACCO RELATED MATERIAL

(71) Applicant: R.J. Reynolds Tobacco Company, Winston-Salem, NC (US)

(72) Inventor: Matthew William Benford, Winston-Salem, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 300 days.

(21) Appl. No.: 15/161,605

(22) Filed: May 23, 2016

(65) Prior Publication Data

US 2017/0332693 A1 Nov. 23, 2017

(51) Int. Cl.

| | |
|---|---|
| ***A24F 23/00*** | (2006.01) |
| ***B65D 81/00*** | (2006.01) |
| ***A24B 15/30*** | (2006.01) |
| ***A24B 15/18*** | (2006.01) |

(52) U.S. Cl.

CPC ..... *B65D 81/00* (2013.01); *A24B 15/18* (2013.01); *A24B 15/302* (2013.01); *A24B 15/303* (2013.01); *A24F 23/00* (2013.01)

(58) Field of Classification Search

CPC ..... A24F 13/00; A24F 23/04

See application file for complete search history.

(56) References Cited

U.S. PATENT DOCUMENTS

| | | | |
|---|---|---|---|
| 1,376,586 | A | 5/1921 | Schwartz |
| 3,339,558 | A | 9/1967 | Waterbury |
| 3,390,686 | A | 7/1968 | Irby, Jr. et al. |
| 3,419,015 | A | 12/1968 | Wochnowski |
| 3,696,917 | A | 10/1972 | Levi |
| 3,916,914 | A | 11/1975 | Brooks et al. |
| 4,054,145 | A | 10/1977 | Berndt et al. |
| 4,098,421 | A | 7/1978 | Foster |
| 4,190,170 | A | 2/1980 | Boyd |
| 4,449,541 | A | 5/1984 | Mays et al. |

(Continued)

FOREIGN PATENT DOCUMENTS

| | | |
|---|---|---|
| WO | WO 02/37990 | 5/2002 |
| WO | WO 03/009711 | 2/2003 |

(Continued)

OTHER PUBLICATIONS

E-Hookah Insider, "Square E-Head Review", https://ehookahinsider.com/square-e-head-review-the-best-e-hookah-yet/, Oct. 6, 2014 (Year: 2014).*

(Continued)

*Primary Examiner* — Cynthia Szewczyk

(74) *Attorney, Agent, or Firm* — Womble Bond Dickinson (US) LLP

(57) ABSTRACT

A container configured to store a tobacco-related material is provided herein. The container may include a top cover and a body portion. The body portion is configured to operably engage the top cover to substantially enclose an internal space defined by the top cover. The internal space is configured to retain a substrate material therein. The container includes a sensory precursor delivery device configured to retain a sensory precursor composition and provide the sensory precursor composition, on demand, to the internal space.

20 Claims, 8 Drawing Sheets

(56) References Cited

U.S. PATENT DOCUMENTS

| | | | | |
|---|---|---|---|---|
| 4,513,756 | A | 4/1985 | Pittman et al. | |
| 4,528,993 | A | 7/1985 | Sensabaugh, Jr. et al. | |
| 4,612,943 | A * | 9/1986 | Meinkowsky | A24F 23/04 131/329 |
| 4,624,269 | A | 11/1986 | Story et al. | |
| 4,830,028 | A | 5/1989 | Lawson et al. | |
| 4,836,224 | A | 6/1989 | Lawson et al. | |
| 4,887,619 | A | 12/1989 | Burcham, Jr. et al. | |
| 4,889,144 | A | 12/1989 | Tateno et al. | |
| 4,924,887 | A | 5/1990 | Raker et al. | |
| 4,924,888 | A | 5/1990 | Perfetti et al. | |
| 4,987,907 | A | 1/1991 | Townend | |
| 4,991,599 | A | 2/1991 | Tibbetts | |
| 5,022,416 | A | 6/1991 | Watson | |
| 5,056,537 | A | 10/1991 | Brown et al. | |
| 5,092,352 | A | 3/1992 | Sprinkle, III et al. | |
| 5,103,842 | A | 4/1992 | Strang et al. | |
| 5,159,942 | A | 11/1992 | Brinkley et al. | |
| 5,220,930 | A | 6/1993 | Gentry | |
| 5,223,185 | A | 6/1993 | Takei et al. | |
| 5,360,023 | A | 11/1994 | Blakley et al. | |
| 5,387,093 | A | 2/1995 | Takei | |
| 5,387,416 | A | 2/1995 | White et al. | |
| 5,711,320 | A | 1/1998 | Martin | |
| 5,882,680 | A | 3/1999 | Suzuki et al. | |
| 6,631,722 | B2 | 10/2003 | MacAdam et al. | |
| 6,668,839 | B2 | 12/2003 | Williams | |
| 6,685,521 | B1 | 2/2004 | Melius | |
| 6,701,936 | B2 | 3/2004 | Shafer et al. | |
| 6,719,933 | B2 | 4/2004 | Nakamura et al. | |
| 6,730,832 | B1 | 5/2004 | Dominguez et al. | |
| 6,834,654 | B2 | 12/2004 | Williams | |
| 6,949,256 | B2 | 9/2005 | Fonkwe et al. | |
| 6,953,040 | B2 | 10/2005 | Atchley et al. | |
| 7,011,096 | B2 | 3/2006 | Li et al. | |
| 7,017,585 | B2 | 3/2006 | Li et al. | |
| 7,025,066 | B2 | 4/2006 | Lawson et al. | |
| 7,032,601 | B2 | 4/2006 | Atchley et al. | |
| D574,709 | S | 8/2008 | Crotts et al. | |
| D594,154 | S * | 6/2009 | Patel | D27/189 |
| 7,694,686 | B2 | 4/2010 | Atchley et al. | |
| 7,754,239 | B2 | 7/2010 | Mane et al. | |
| 7,810,507 | B2 | 10/2010 | Dube et al. | |
| 7,819,124 | B2 | 10/2010 | Strickland et al. | |
| 7,861,728 | B2 | 1/2011 | Holton, Jr. et al. | |
| 7,901,512 | B2 | 3/2011 | Quinter et al. | |
| D649,284 | S | 11/2011 | Patel et al. | |
| 8,168,855 | B2 | 5/2012 | Nielsen et al. | |
| 8,186,360 | B2 | 5/2012 | Marshall et al. | |
| 8,336,557 | B2 | 12/2012 | Kumar et al. | |
| 8,440,023 | B2 | 5/2013 | Carroll et al. | |
| 8,458,996 | B2 | 6/2013 | Bried et al. | |
| 8,469,036 | B2 | 6/2013 | Williams et al. | |
| 8,567,597 | B2 | 10/2013 | Gibson et al. | |
| 8,627,828 | B2 | 1/2014 | Strickland et al. | |
| 8,741,348 | B2 | 6/2014 | Hansson et al. | |
| 8,910,781 | B2 | 12/2014 | Pipes et al. | |
| 8,940,344 | B2 | 1/2015 | Crawford et al. | |
| 9,107,453 | B2 | 8/2015 | Dube et al. | |
| 9,155,772 | B2 | 10/2015 | Gao et al. | |
| 9,205,959 | B2 | 12/2015 | Welk et al. | |
| 2004/0020503 | A1 | 2/2004 | Williams | |
| 2004/0224020 | A1 | 11/2004 | Schoenhard | |
| 2004/0255965 | A1 | 12/2004 | Perfetti et al. | |
| 2005/0196437 | A1 | 9/2005 | Bednarz et al. | |
| 2005/0249676 | A1 | 11/2005 | Scott et al. | |
| 2007/0062549 | A1 | 3/2007 | Holton, Jr. et al. | |
| 2008/0029116 | A1 | 2/2008 | Robinson et al. | |
| 2008/0029117 | A1 | 2/2008 | Mua et al. | |
| 2008/0173317 | A1 | 7/2008 | Robinson et al. | |
| 2008/0196730 | A1 | 8/2008 | Engstrom et al. | |
| 2009/0065013 | A1 | 3/2009 | Essen et al. | |
| 2010/0012534 | A1 | 1/2010 | Hoffman | |
| 2010/0018883 | A1 | 1/2010 | Patel | |
| 2010/0028766 | A1 | 2/2010 | Peckerar et al. | |
| 2010/0065076 | A1 | 3/2010 | Bergstrom et al. | |
| 2010/0065077 | A1 | 3/2010 | Lofgreen-Ohrn et al. | |
| 2012/0024301 | A1 | 2/2012 | Carroll et al. | |
| 2012/0152265 | A1 | 6/2012 | Dube | |
| 2012/0193265 | A1 | 8/2012 | Patel et al. | |
| 2013/0206153 | A1 | 8/2013 | Beeson et al. | |
| 2015/0344456 | A1 | 12/2015 | Dull et al. | |

FOREIGN PATENT DOCUMENTS

| | | | |
|---|---|---|---|
| WO | WO 2004/095959 | 11/2004 | |
| WO | WO 2010/132444 | 11/2010 | |
| WO | WO-2015172224 A1 * | 11/2015 | A24F 1/30 |

OTHER PUBLICATIONS

Pictures of Square E-Head Hookah Bowl (Year: 2014).*
Bombick et al. *Fund. Appl. Toxicol.*, 39, p. 11-17, 1997.
Leffingwell et al., Tobacco Flavoring for Smoking Products, 1972.

* cited by examiner

FLAVORING MECHANISM FOR A TOBACCO RELATED MATERIAL

FIELD OF THE DISCLOSURE

The present disclosure relates to flavoring mechanisms for a substrate material (e.g., a tobacco-related material) disposed within a container and methods of use thereof. More particularly, this disclosure relates to a container including a mechanism for flavoring products that may be made or derived from tobacco, or that otherwise incorporate tobacco-related materials, and are intended for human consumption.

BACKGROUND

Tobacco may be enjoyed in a so-called "smokeless" form. Particularly popular smokeless tobacco products are employed by inserting some form of processed tobacco or tobacco-related material into the mouth of the user. See for example, the types of smokeless tobacco products, formulations, ingredients, and processing methodologies set forth in U.S. Pat. No. 1,376,586 to Schwartz; U.S. Pat. No. 3,696,917 to Levi; U.S. Pat. No. 4,513,756 to Pittman et al.; U.S. Pat. No. 4,528,993 to Sensabaugh, Jr. et al.; U.S. Pat. No. 4,624,269 to Story et al.; U.S. Pat. No. 4,991,599 to Tibbetts; U.S. Pat. No. 4,987,907 to Townsend; U.S. Pat. No. 5,092,352 to Sprinkle, III et al.; U.S. Pat. No. 5,387,416 to White et al.; U.S. Pat. No. 6,668,839 to Williams; U.S. Pat. No. 6,834,654 to Williams; U.S. Pat. No. 6,953,040 to Atchley et al.; U.S. Pat. No. 7,032,601 to Atchley et al.; U.S. Pat. No. 7,694,686 to Atchley et al.; U.S. Pat. No. 7,810,507 to Dube et al.; U.S. Pat. No. 7,819,124 to Strickland et al.; U.S. Pat. No. 7,861,728 to Holton, Jr. et al.; U.S. Pat. No. 7,901,512 to Quinter et al.; U.S. Pat. No. 8,168,855 to Neilsen et al.; U.S. Pat. No. 8,336,557 to Kumar et al.; U.S. Pat. No. 8,469,036 to Strickland et al.; U.S. Pat. No. 8,627,828 to Strickland et al.; U.S. Pat. No. 8,940,344 to Crawford et al.; and U.S. Pat. No. 9,155,772 to Gao et al.; U.S. Pat. Pub. Nos. 2004/0020503 to Williams; 2007/0062549 to Holton, Jr. et al.; 2008/0029116 to Robinson et al.; 2008/0029117 to Mua et al.; 2008/0173317 to Robinson et al.; 2008/0196730 to Engstrom et al.; 2009/0065013 to Essen et al.; and 2013/0206153 to Beeson et al.; PCT Pub. Nos. WO 04/095959 to Arnarp et al.; and WO 10/132,444 to Atchley; each of which is incorporated herein by reference.

Representative smokeless tobacco products that have been marketed include those referred to as CAMEL Orbs, CAMEL Strips and CAMEL Sticks by R. J. Reynolds Tobacco Company; GRIZZLY moist tobacco, KODIAK moist tobacco, LEVI GARRETT loose tobacco and TAYLOR'S PRIDE loose tobacco by American Snuff Company, LLC; KAYAK moist snuff and CHATTANOOGA CHEW chewing tobacco by Swisher International, Inc.; REDMAN chewing tobacco by Pinkerton Tobacco Co. LP; COPENHAGEN moist tobacco and RED SEAL long cut by U.S. Smokeless Tobacco Company; and Taboka by Philip Morris USA.

Representative types of snuff products, commonly referred to as "snus," which may comprise pasteurized or heat treated tobacco products, are manufactured in Europe, particularly in Sweden, by or through companies such as Swedish Match AB, Fiedler & Lundgren AB, Gustavus AB, Skandinavisk Tobakskompagni A/S and Rocker Production AB. Snus products available in the U.S.A. have been marketed under the trade names such as CAMEL Snus Frost, CAMEL Snus Original and CAMEL Snus Spice by R. J. Reynolds Tobacco Company. Snus products, such as CAMEL Snus Original, are commonly supplied in small teabag-like pouches. The pouches are typically a nonwoven fleece material, and contain about 0.4 to 1.5 grams of pasteurized tobacco. These products typically remain in a user's mouth for about 10-30 minutes. Unlike certain other smokeless tobacco products, snus products typically do not require expectoration by the user. Other pouch types of smokeless tobacco products include those marketed as COPENHAGEN Pouches, SKOAL Bandits, SKOAL Pouches, REVEL Mint Tobacco Packs by U.S. Smokeless Tobacco Company; and MARLBORO Snus by Philip Morris USA.

Various types of containers for dispensing smokeless tobacco products, and particularly for dispensing smokeless tobacco products intended for human consumption, are known in the art. Such containers are often characterized by a hand-held size that can be easily stored and transported. For example, snus products have been packaged in tins, "pucks" or "pots" that are manufactured from metal or plastic. See, for example, those types of containers generally disclosed in U.S. Pat. No. 4,098,421 to Foster; U.S. Pat. No. 4,190,170 to Boyd and U.S. Pat. No. 8,440,023 to Carroll et al.; and U.S. Patent Pub. Nos. 2010/0065076 to Bergstrom et al.; 2010/0065077 to Lofgreen-Ohrn et al.; 2012/0024301 to Carroll et al. and 2012/0193265 to Patel et al.; each of which is incorporated by reference herein. Yet other types of containers for smokeless types of tobacco products are set forth in U.S. Pat. No. 8,458,996 to Bried et al.; U.S. Pat. No. 8,910,781 to Pipes et al.; U.S. Pat. No. 9,205,959 to Welk et al.; D574,709 to Crotts et al.; and D649,284 to Patel et al.; U.S. Patent Pub. Nos. 2010/0012534 to Hoffman;, and 2010/0018883 to Patel et al.; as well as the various types of containers referenced in U.S. Patent Pub. No. 2013/0206153 to Beeson et al.; each of which is incorporated by reference herein. Further, U.S. Pat. No. 8,567,597 to Gibson et al. discloses a compartment container for snus, and is incorporated herein by reference in its entirety. One desirable feature for certain containers is the provision of a flavoring device that may be configured to provide a flavoring and/or sensory precursor composition to the smokeless tobacco product disposed within the container.

BRIEF SUMMARY OF THE DISCLOSURE

The above and other needs are met by aspects of the present disclosure which, in one aspect, provides a mechanism for modifying (e.g., flavoring) products made or derived from tobacco, or that otherwise incorporate tobacco-related materials, and are intended for human consumption.

Aspects of the present disclosure include a container that includes a top cover and a body portion. The body portion is configured to operably engage the top cover to substantially enclose an internal space defined by the body portion and the top cover. The internal space is configured to retain a substrate material therein. The container also includes a sensory precursor delivery device configured to retain a sensory precursor composition. The sensory precursor delivery device is further configured to provide the sensory precursor composition, on demand, to the internal space.

The sensory precursor delivery device further includes an outer wall that defines, in part, a storage chamber configured to retain the sensory precursor composition therein. In some aspects, the sensory precursor delivery device includes an actuating element configured to cause the storage chamber to provide the internal space of the container with the sensory precursor composition upon actuation. The sensory precursor delivery device may further include a dispensing element disposed proximate the outer wall of the delivery device. The dispensing element is configured to be in fluid communication with the storage chamber. According to one aspect, the dispensing element is further configured to retain the sensory precursor composition within the storage chamber until actuation by the actuation element. The sensory precursor delivery device may be operably engaged with a delivery orifice defined by at least one of the top cover and body portion of the container. The delivery orifice may be configured to provide for fluid communication between the sensory precursor delivery device and the internal space defined by the body portion and the top cover.

In some aspects, the dispensing element includes a semi-permeable material configured to retain the sensory precursor composition within the storage chamber until actuation of the actuating element. In some aspects, when a mechanical force is applied to the actuation element, the force provides for a deformation of the storage chamber such that the sensory precursor composition stored therein is dispensed to the internal space defined by the top cover and the body portion through the dispensing element. According to one aspect, at least a portion of the storage chamber includes a pliable portion, and the actuation element is integrally formed with the pliable portion According to some aspects, the container may further include a power source configured to provide an electrical current to at least one of the actuating element and the dispensing element of the sensory precursor delivery device. In one aspect, the power source may be disposed within the sensory precursor deliver device. According to one aspect, the power source may be disposed in at least one of the top cover and the body portion.

In some aspects, the dispensing element of the sensory precursor delivery device may include a heating element that is configured to heat the sensory precursor composition disposed within the storage chamber, and a dispersing unit that is operably engaged with the delivery orifice of the container and configured to provide the heated sensory precursor composition to the internal space. The dispersing unit may be configured to pressurize the heated sensory precursor composition prior to providing the pressurized heated sensory precursor composition to the internal space.

According to one aspect, the top cover of the container may define a cavity configured to receive at least a portion of the sensory precursor delivery device therein. Additionally, operable engagement between the sensory precursor delivery device and the cavity of the top cover may provide for fluid communication between the storage chamber of the sensory precursor delivery device and the internal space of the container. In some aspects, when the power source is disposed within at least one of the top cover and the body portion, the power source may be configured to provide an electrical current to at least one of the actuating element and the dispensing element when the sensory precursor delivery device is operably engaged with the cavity of the top cover.

According to some aspects, the container may further include a substrate material disposed within the internal space. The substrate material may include a tobacco-related material configured to absorb the sensory precursor composition. In some aspects, the substrate material disposed within the internal space includes an absorbent porous material configured to absorb the sensory precursor composition. The absorbent porous material may include at least one of a plant material, an organic material, a food grade polymer, and a food grade fiber. In some aspects, the absorbent porous material includes a microcrystalline cellulose material.

In some aspects, the sensory precursor composition comprises a nicotinic compound. According to some aspects, the sensory precursor composition includes a humectant compound. The sensory precursor composition may be a liquid. In one aspect, the sensory precursor composition is a solid soluble material. The sensory precursor composition may further include a flavoring material configured to flavor the tobacco-related material disposed within the internal space selected from the group comprising tobacco extract, sweeteners, vanilla, coffee, tea, chocolate, cream, mint, spearmint, menthol, peppermint, wintergreen, lavender, cardamom, nutmeg, cinnamon, clove, cascarilla, sandalwood, honey, maple, jasmine, ginger, anise, sage, licorice, lemon, orange, apple, peach, lime, cherry, and strawberry.

These and other features, aspects, and advantages of the disclosure will be apparent from a reading of the following detailed description together with the accompanying drawings, which are briefly described below.

BRIEF DESCRIPTION OF THE DRAWINGS

Figure 1:
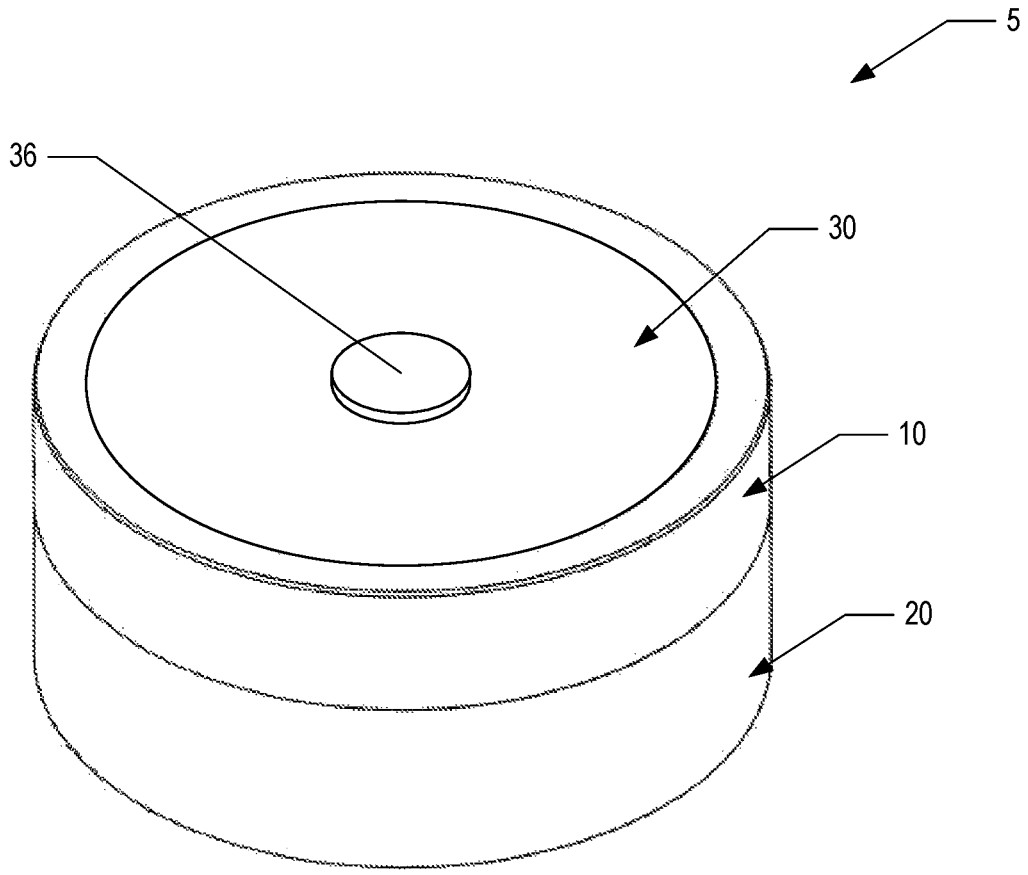
Figure 2:
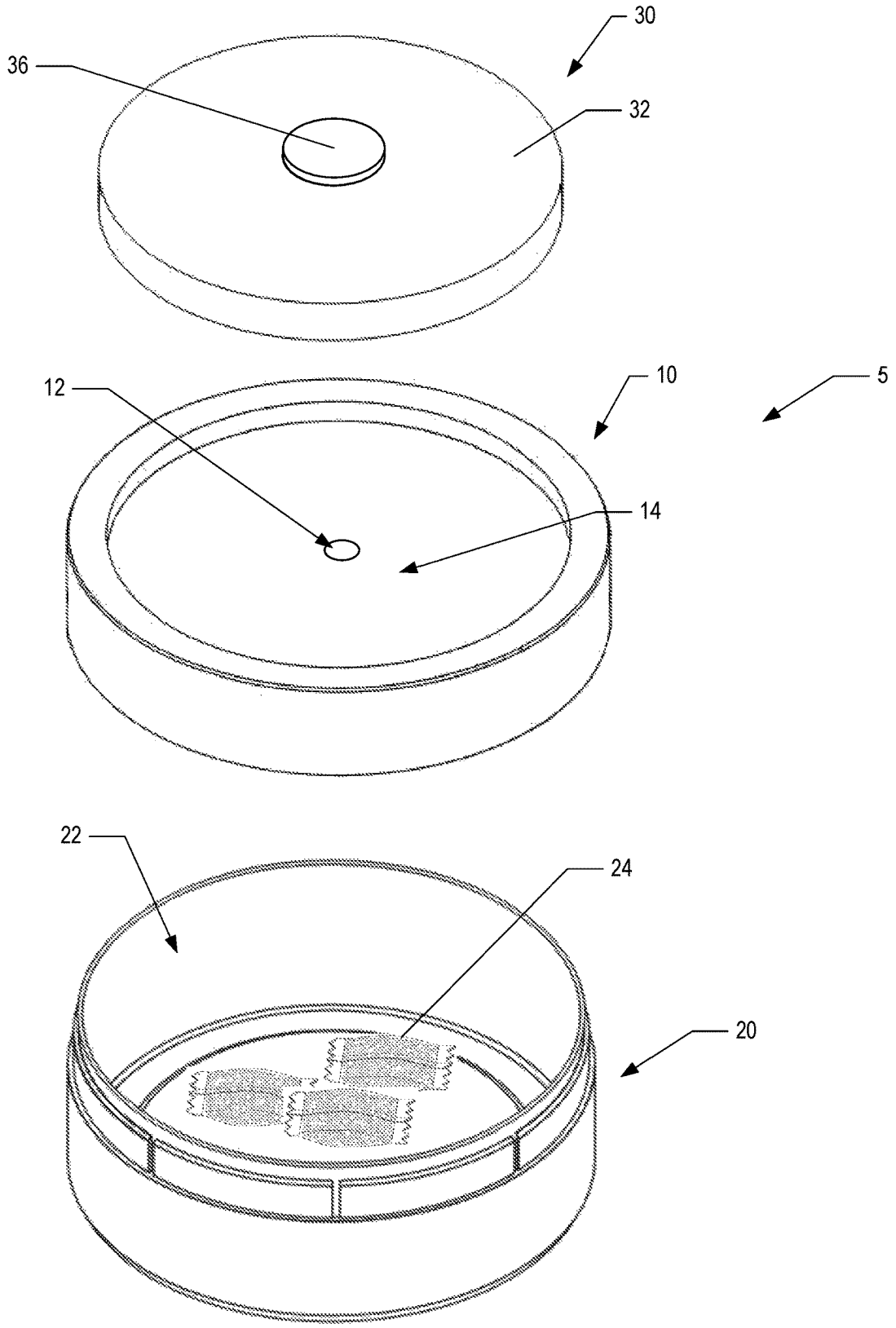
Figure 3:
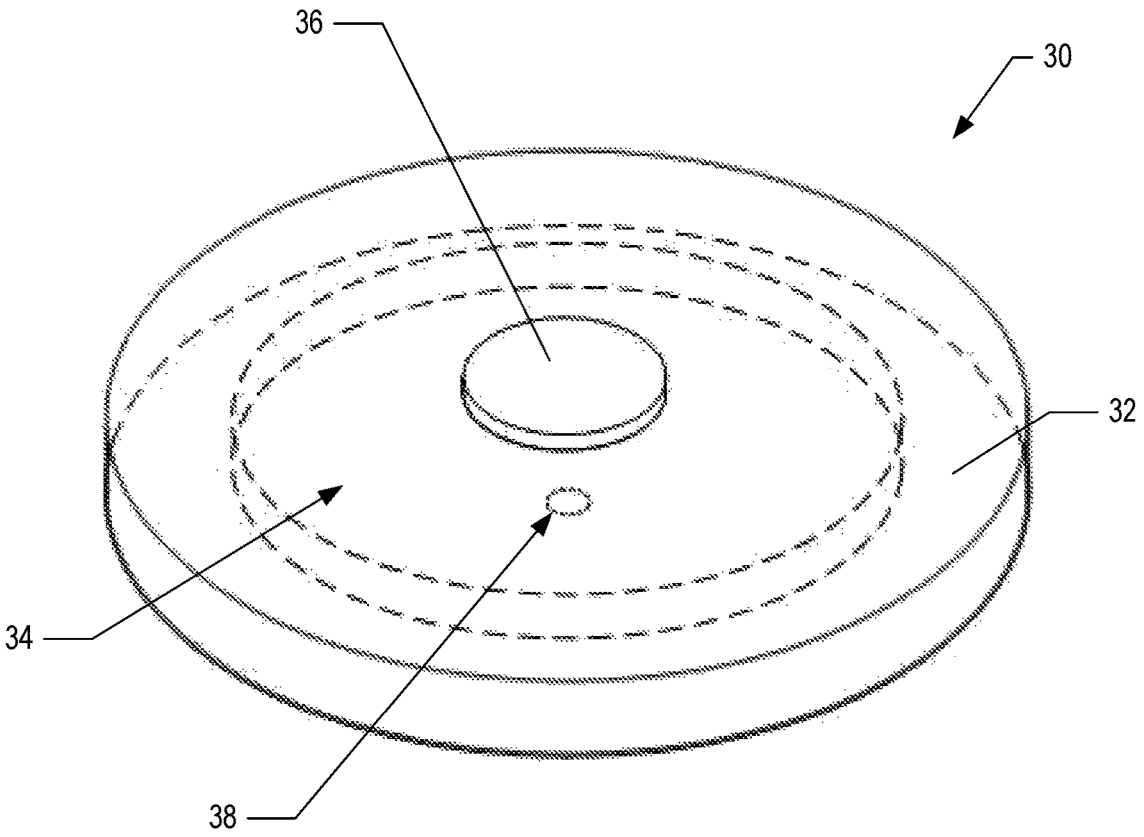
Figure 4A:
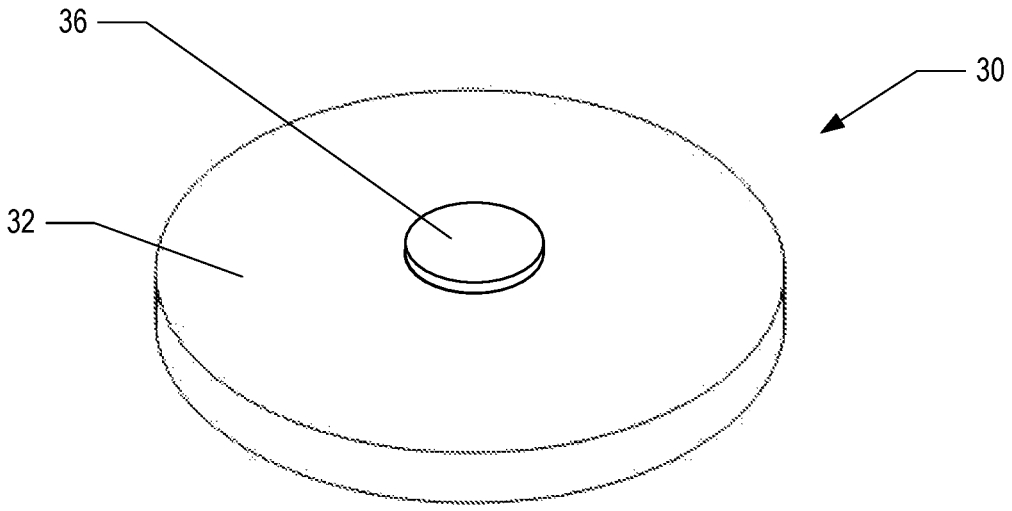
Figure 4B:
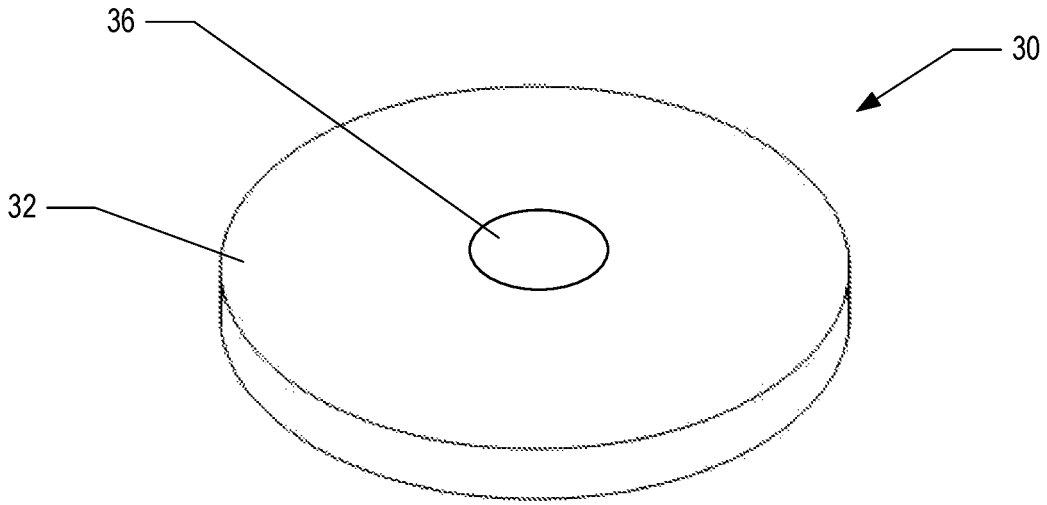
Figure 5:
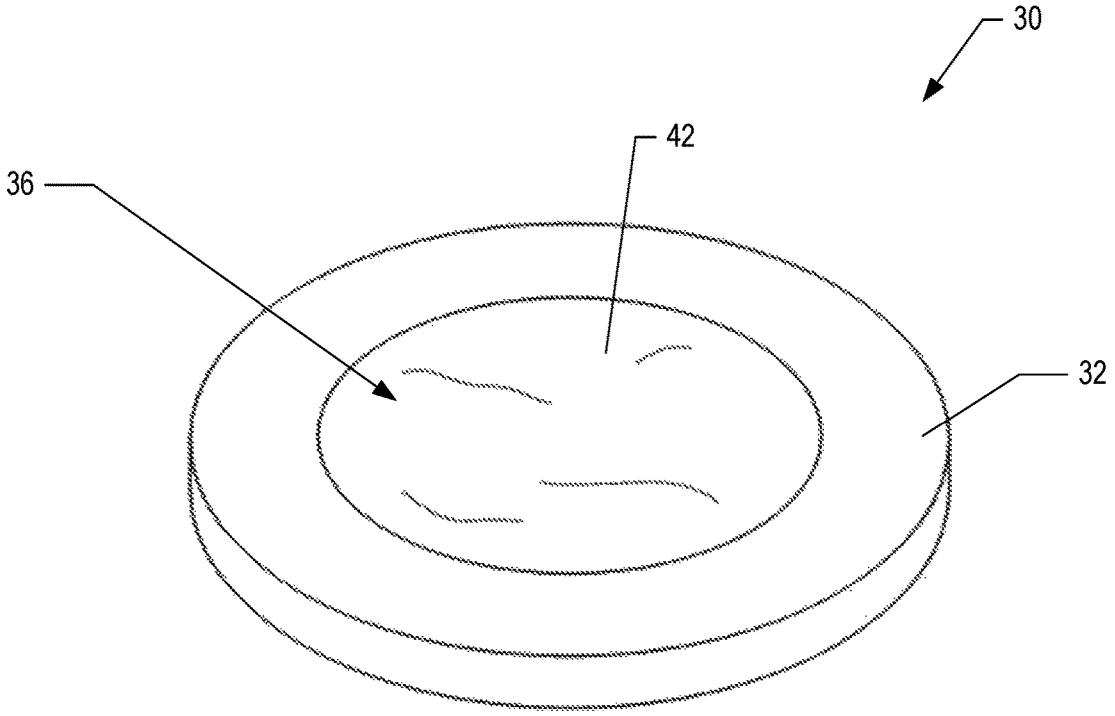
Figure 6A:
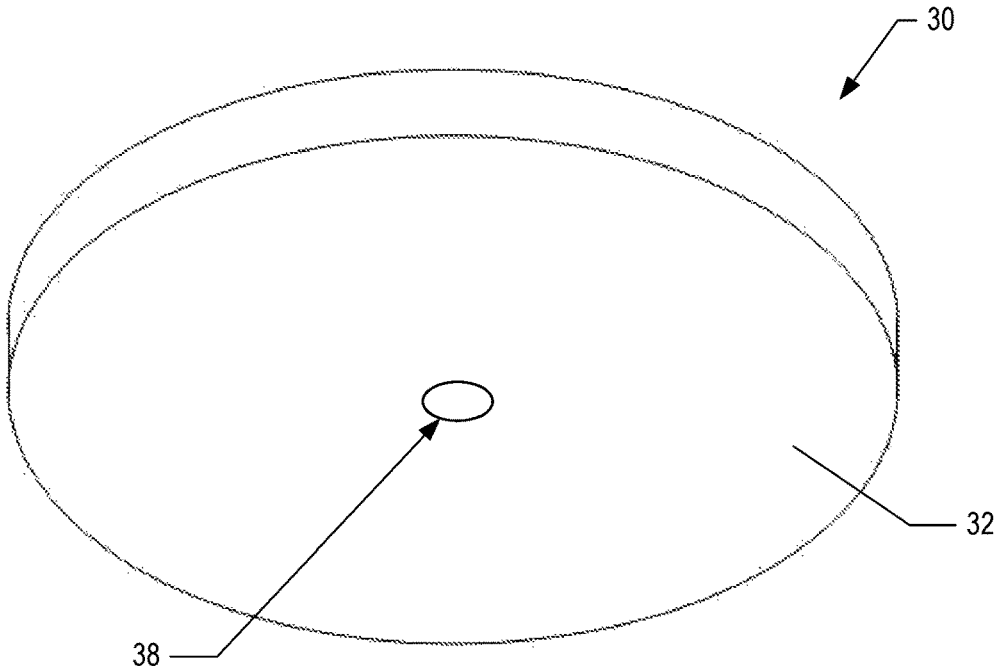
Figure 6B:
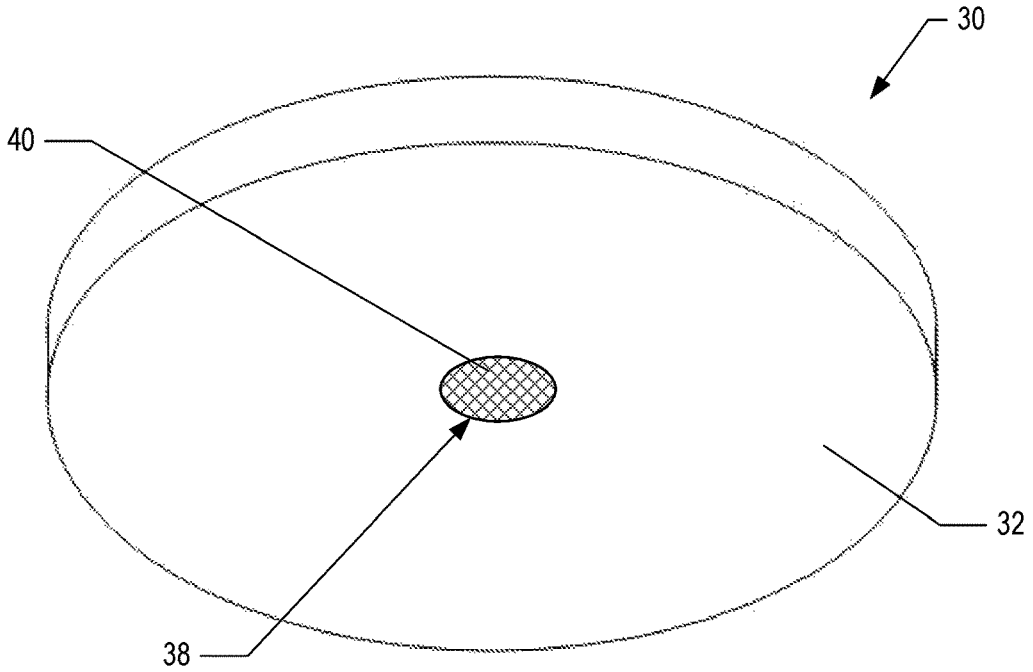
Figure 7:
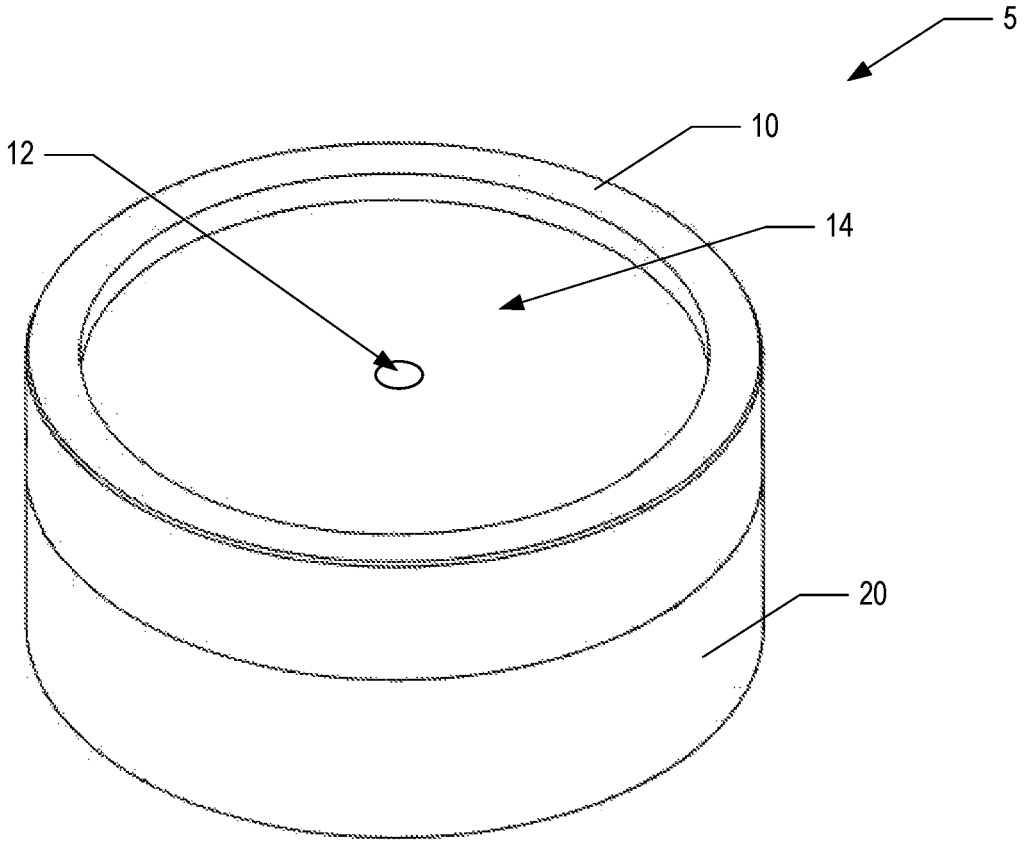
Figure 8:
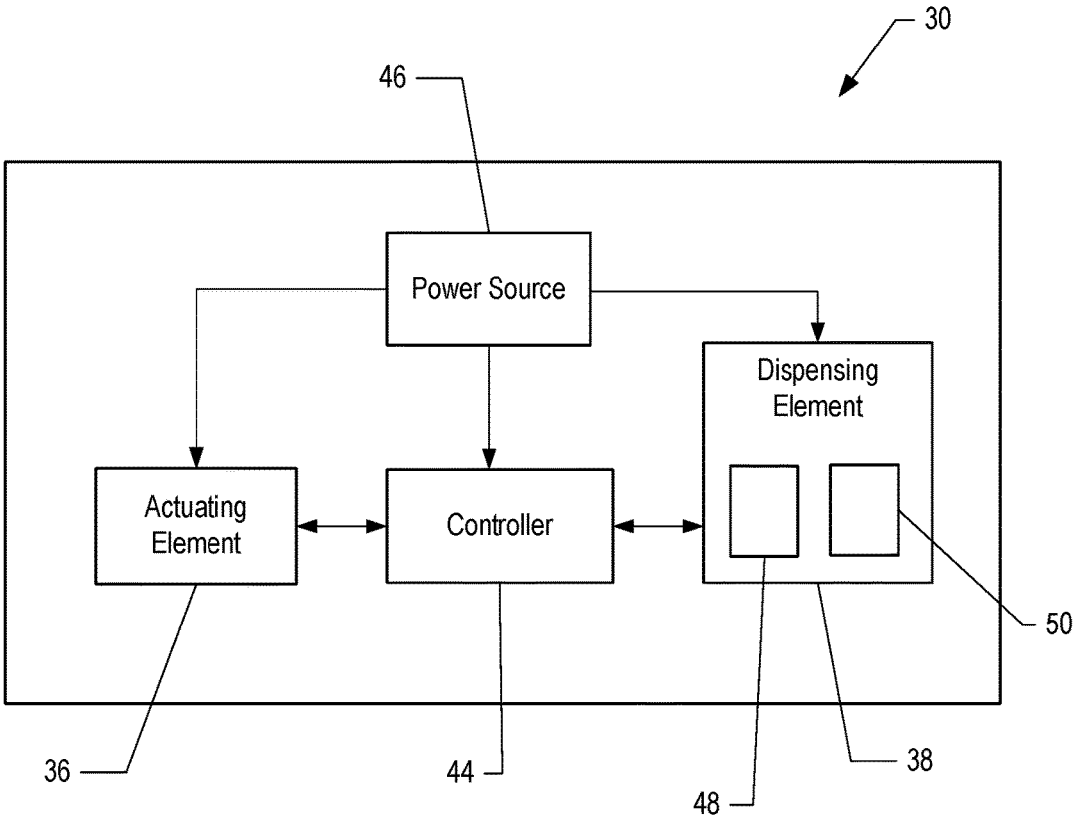

Having thus described the disclosure in the foregoing general terms, reference will now be made to the accompanying drawings, which are not necessarily drawn to scale, and wherein:

FIG. 1 illustrates a container including a sensory precursor delivery device according to one aspect of the present disclosure;

FIG. 2 illustrates an exploded view of the container of FIG. 1 according to one aspect of the present disclosure;

FIG. 3 illustrates a transparent view of the sensory precursor delivery device according to one aspect of the present disclosure;

FIG. 4A illustrates top perspective view of a sensory precursor delivery device according to one aspect of the present disclosure;

FIG. 4B illustrates a top perspective view of the sensory precursor delivery device of FIG. 4A in an activated state according to one aspect of the present disclosure;

FIG. 5 illustrates a top perspective view of a sensory precursor delivery device according to one aspect of the present disclosure;

FIG. 6A illustrates a bottom perspective of a sensory precursor delivery device according to one aspect of the present disclosure;

FIG. 6B illustrates a bottom perspective of a sensory precursor delivery device, wherein a dispensing element includes a semi-permeable material according to one aspect of the present disclosure;

FIG. 7 illustrates a top perspective view of the container of FIG. 1 with the sensory precursor delivery device removed according to one aspect of the present disclosure; and FIG. 8 illustrates a schematic block diagram of a sensory precursor delivery device according to one aspect of the present disclosure.

DETAILED DESCRIPTION OF THE DISCLOSURE

The present disclosure will now be described more fully hereinafter with reference to exemplary aspects thereof. These exemplary aspects are described so that this disclosure will be thorough and complete, and will fully convey the scope of the disclosure to those skilled in the art. Indeed, the disclosure may be expressed in many different forms and should not be construed as limited to the aspects set forth herein; rather, these aspects are provided so that this disclosure will satisfy applicable legal requirements. As used in the specification, and in the appended claims, the singular forms "a", "an", "the", include plural referents unless the context clearly dictates otherwise.

The present disclosure is directed to an apparatus configured to provide a sensory precursor composition to a substrate material, and more particularly to a substrate material disposed within a container. Referring to FIGS. 1 and 2, the container 5 includes a top cover 10 and a body portion 20. The top cover 10 and the body portion 20 are configured to operably engage one another in a reciprocal arrangement so as to substantially enclose an internal space 22 defined by the body portion and the top cover. In some aspects, the container 5 includes a sensory precursor delivery device 30 that is configured to retain a sensory precursor composition therein. Additionally, the sensory precursor delivery device 30 may be configured to dispense the sensory precursor composition to the internal space 22 of the container 5. For example, the sensory precursor delivery device 30 may include an actuating element 36, which in response to actuation, may cause the sensory precursor delivery device 30 to dispense the sensory precursor composition to the internal space 22 of the container 5.

The dimensions of the containers described herein can vary without departing from the disclosure. However, in some preferred aspects, the containers can be described as having a cylindrical size suitable for handheld manipulation and operations, as shown in FIG. 1. Exemplary dimensions for such handheld generally cylindrical containers include diameters in the range of about 50 mm to about 130 mm, and more typically about 60 mm to about 115 mm. Exemplary wall thicknesses include the range of about 0.5 mm to about 4.75 mm, and more typically about 0.8 mm to about 4.6 mm. Exemplary depths for handheld containers, in some aspects, range from about 5 mm to about 50 mm, more typically about 8 mm to about 45 mm, and most often about 15 mm to about 40 mm.

Additionally, the size of the containers described herein may be changed. For example, the containers may be sized for promotional purposes by providing increased dimensions by upwardly scaling the container dimensions by certain multipliers. For example, the dimensions of the container may be scaled upwardly by a multiple of about 1 to about 10 times. In this regard, whereas a conventional container according to aspects of the present disclosure may be configured to store about 0.08 ounces to 1.2 ounces of a substrate material, an oversized container may be configured to store, for example, 2.4 ounces or 7.2 ounces of the substrate material. Accordingly, the dimensions and capacities disclosed herein are provided for example purposes only and may be modified to suit particular purposes.

As previously mentioned, the internal space 22 defined, in part, by the top cover 10 and the body portion 20 of the container 5 may be configured to retain a substrate material 24 therein. In some aspects, the substrate material 24 may include a tobacco-related material such as, for example, a suitable smokeless tobacco product like the types of products set forth and generally described in U.S. Pat. App. Pub. Nos. 2012/0193265 to Patel et al.; and 2013/0206153 to Beeson et al., which are both incorporated herein by reference in their entirety. Of particular interest are exemplary tobacco products that include tobacco formulations in loose form, such as moist snuff products. Other exemplary types of smokeless tobacco products include the types of products set forth in U.S. Pat. App. Pub. No. 2012/0024301 to Carroll et al., which is incorporated by reference herein. Exemplary loose form tobacco used with the containers of the present disclosure may include tobacco formulations associated with, for example, commercially available GRIZZLY moist tobacco products and KODIAK moist tobacco products that are marketed by American Snuff Company, LLC. Exemplary snus forms of tobacco products are commercially available as CAMEL Snus by R. J. Reynolds Tobacco Company.

Tobacco that may be employed can include, or can be derived from, tobaccos such as flue-cured tobacco, burley tobacco, Oriental tobacco, Maryland tobacco, dark tobacco, dark-fired tobacco and Rustica tobacco, as well as other rare or specialty tobaccos, or blends thereof.

Various representative tobacco types, processed types of tobaccos, and types of tobacco blends are set forth in U.S. Pat. No. 4,836,224 to Lawson et al.; U.S. Pat. No. 4,924,888 to Perfetti et al.; U.S. Pat. No. 5,056,537 to Brown et al.; U.S. Pat. No. 5,159,942 to Brinkley et al.; U.S. Pat. No. 5,220,930 to Gentry; U.S. Pat. No. 5,360,023 to Blakley et al.; U.S. Pat. No. 6,701,936 to Shafer et al.; U.S. Pat. No. 6,730,832 to Dominguez et al.; U.S. Pat. No. 7,011,096 to Li et al.; U.S. Pat. No. 7,017,585 to Li et al.; U.S. Pat. No. 7,025,066 to Lawson et al.; U.S. Pat. App. Pub. No. 2004/0255965 to Perfetti et al.; PCT Pub. No. WO 02/37990 to Bereman; and Bombick et al., *Fund. Appl. Toxicol.,* 39, p. 11-17 (1997); the disclosures of which are incorporated herein by reference in their entireties.

In still another aspect of the present disclosure, the substrate material retained 24 within the internal space 22 of the container 5 may be configured as an extruded structure and/or substrate that may include, or may essentially be comprised of tobacco, glycerin, water, and/or a binder material, although certain formulations may exclude the binder material. The binder material may be any binder material commonly used for tobacco formulations including, for example, carboxymethyl cellulose (CMC), gum (e.g. guar gum), xanthan, pullulan, and/or an alginate. According to some aspects, the binder material included in the tobacco-related material may be configured to substantially maintain a structural shape and/or integrity of the tobacco-related material after the sensory precursor composition has been introduced thereto. Various representative binders, binder properties, usages of binders, and amounts of binders are set forth in U.S. Pat. No. 4,924,887 to Raker et al., which is incorporated herein by reference in its entirety.

According to some aspects, the substrate material 24 disposed within the internal space 22 of the container 5 may include a porous particulate carrier material, such as microcrystalline cellulose (MCC), configured to absorb the sensory precursor composition. In some aspects, the porous particulate carrier material may be substantially devoid of tobacco or tobacco-related material, but may be configured to absorb, adsorb, or otherwise receive the sensory precursor composition, which may include a tobacco-related material therein, so as to provide the user with a smokeless tobacco product having a tobacco-related material suitable for consumption. In one embodiment, the MCC materials used in the invention have an average particle size range of about 15 to about 250 microns. Exemplary MCC materials include various grades of AVICEL® and VIVACEL® materials. See, for example, U.S. Pat. No. 8,741,348 to Hansson et al., which is incorporated by reference herein. Additionally, in some aspects, a substrate material including a porous particular carrier material may include least one of a plant material, an organic material, a food grade polymer, and a food grade fiber configured to absorb, adsorb, and/or otherwise retain the sensory precursor composition when applied thereto.

In some aspects, the container 5 may include a sensory precursor delivery device 30 configured to retain a sensory precursor composition therein. The sensory precursory delivery device 30 may include an actuating element 36 configured to dispense the sensory precursor composition from the sensory precursor delivery device 30. As shown in FIG. 3, the sensory precursor delivery device 30 may include an outer wall 32. According to some aspects, the outer wall 32 of the sensory precursor delivery device 30 defines, in part, a storage chamber 34 configured to retain the sensory precursor composition therein. According to some aspects, the outer wall 32 may include materials (natural or synthetic) that are suitable for maintaining an appropriate conformation, such as a substantially cylindrical shape, and for retaining therein, the sensory precursor composition. In some aspects, ceramic materials may be used. In particular aspects, the outer wall 32 may be comprised of stainless steel material and/or other metallic materials. According to another example aspect, the outer wall 32 may include polymeric materials. Additionally, other components of the container 5, such as the top cover 10 and the body portion 20 may be formed of substantially the same material as the outer wall 32 of the sensory precursor delivery device 30. Some example aspects of the present disclosure provide for components of the container 5 (e.g., the outer wall 32 of the sensory dispensing device 30, the top cover 10, and/or the body portion 20) to be constructed from stainless steel and/or other metallic materials such that portions of the container 5 may be reusable after the substrate material 24 (e.g., the tobacco-related material) disposed within the internal space 22 has been consumed.

As shown in FIG. 3, the outer wall 32 may define a storage chamber 34 configured to retain the sensory precursor composition therein. According to some aspects, the sensory precursor delivery device 30 may be further configured to provide the sensory precursor composition, on demand, to the substrate material 24retained within the internal space 22 of the container 5. For example, as shown in FIGS. 2 and 7, the top cover 10 may define a cavity 14 configured to receive at least a portion of the sensory precursor delivery device 30 therein. In particular, the cavity 14 and the sensory precursor delivery device 30 may be configured to operably engage one another in a reciprocal arrangement such that the storage chamber 34 is in fluid communication with the internal space 22 of the container 5. In particular, a delivery orifice 12 defined by the top cover 10 may provide for fluid communication between the storage chamber 34 of the sensory precursor delivery device 30 and the internal space 22 of the container 5 such that a sensory precursor composition disposed within the storage chamber 34 is delivered to the internal space 22 of the container 5.

According to certain aspects, the sensory precursor composition can have a form that can vary; and typically, the composition has the form of a liquid, a gel, or a solid (e.g., a crystalline material, dry powder, and/or microcapsules). In one aspect of the present disclosure, the sensory precursor composition may incorporate tobacco and/or tobacco-related materials configured to be dispensed to the substrate material substantially devoid of tobacco and/or tobacco-related materials such that after dispensing the sensory precursor composition from the sensory precursor delivery device 30 to the substrate material within the container 5, a suitable product that incorporates tobacco and/or a tobacco-related material is provided to a user for consumption. Additionally or alternatively, the sensory precursor composition can incorporate tobacco additives of the type that are traditionally used for the manufacture of tobacco products. Those additives can include the types of materials used to enhance the flavor and aroma of tobaccos used for the production of cigars, cigarettes, pipes, and the like. For example, those additives can include various cigarette casing and/or top dressing components. See, for example, U.S. Pat. No. 3,419,015 to Wochnowski; U.S. Pat. No. 4,054,145 to Berndt et al.; U.S. Pat. No. 4,887,619 to Burcham, Jr. et al.; U.S. Pat. No. 5,022,416 to Watson; U.S. Pat. No. 5,103,842 to Strang et al.; and U.S. Pat. No. 5,711,320 to Martin; the disclosures of which are incorporated herein by reference in their entireties. Preferred sensory precursor composition materials may include water, sugars and syrups (e.g., sucrose, glucose and high fructose corn syrup), humectants (e.g. glycerin or propylene glycol), and flavoring agents (e.g., cocoa and licorice). Those added components also include top dressing materials (e.g., flavoring materials, such as menthol). See, for example, U.S. Pat. No. 4,449,541 to Mays et al., the disclosure of which is incorporated herein by reference in its entirety. Further materials that can be added include those disclosed in U.S. Pat. No. 4,830,028 to Lawson et al. and U.S. Pat. No. 8,186,360 to Marshall et al., the disclosures of which are incorporated herein by reference in their entireties.

A wide variety of types of flavoring agents, or materials that alter the sensory or organoleptic character or nature of the tobacco-related material disposed within the internal space 22 of the container 5, can be employed. Such flavoring agents can be provided from sources other than tobacco and can be natural or artificial in nature. Of particular interest are flavoring agents that are applied to, or incorporated within, the sensory precursor composition and/or the internal space 22 of the container 5 where the substrate material is retained. Exemplary flavoring agents include vanillin, ethyl vanillin, cream, tea, coffee, fruit (e.g., apple, cherry, strawberry, peach and citrus flavors, including lime and lemon), maple, menthol, mint, peppermint, spearmint, wintergreen, nutmeg, clove, lavender, cardamom, ginger, honey, anise, sage, cinnamon, sandalwood, jasmine, cascarilla, cocoa, licorice, and flavorings and flavor packages of the type and character traditionally used for the flavoring of cigarette, cigar, and pipe tobaccos. Syrups, such as high fructose corn syrup, also can be employed. Flavoring agents also can include acidic or basic characteristics (e.g., organic acids, such as levulinic acid, succinic acid, and pyruvic acid). Exemplary plant-derived compositions that may be used are disclosed in U.S. Pat. No. 9,107,453 to Dube et al., and U.S. Pat. App. Pub. No. 2012/0152265 to Dube et al., the disclosures of which are incorporated herein by reference in their entireties. The selection of such further components can vary based upon factors such as the sensory characteristics that are desired for the present article, and the present disclosure is intended to encompass any such further components that may be readily apparent to those skilled in the art of tobacco and tobacco-related or tobacco-derived products. See, Gutcho, Tobacco Flavoring Substances and Methods, Noyes Data Corp. (1972) and Leffingwell et al., Tobacco Flavoring for Smoking Products (1972), the disclosures of which are incorporated herein by reference in their entireties.

Any of the materials incorporated within the sensory precursor composition, such as flavorings, casings, and the like, can be useful in combination with the substrate material to affect sensory properties thereof, including organoleptic properties, such as already described herein. In some aspects, the substrate material retained within the internal space 22 of the container 5 may include a porous particulate carrier material such as, for example, microcrystalline cellulose (MCC), configured to absorb the sensory precursor composition. For example, the porous particulate carrier material may be devoid of tobacco, nicotine, and/or nicotinic compounds and may be configured to absorb the sensory precursor composition, which may contain a nicotinic compound. As used herein, "nicotinic compound" refers to naturally occurring or synthetic nicotine unbound from a plant material, meaning the compound is at least partially purified and not contained within a plant structure such as a tobacco leaf. Most preferably, nicotine is naturally-occurring and obtained as an extract from a *Nicotiana* species (e.g., tobacco). In some aspects, the sensory precursor composition may further include organic acids to affect the flavor, sensation, or organoleptic properties of medicaments, such as nicotine and/or the nicotinic compound, that may be included in the sensory precursor composition. For example, organic acids, such as levulinic acid, lactic acid, and pyruvic acid, may be included in the sensory precursor composition with nicotine in amounts up to being equimolar (based on total organic acid content) with the nicotine. Any combination of organic acids can be used. For example, the aerosol generating element can include about 0.1 to about 0.5 moles of levulinic acid per one mole of nicotine, about 0.1 to about 0.5 moles of pyruvic acid per one mole of nicotine, about 0.1 to about 0.5 moles of lactic acid per one mole of nicotine, or combinations thereof, up to a concentration wherein the total amount of organic acid present is equimolar to the total amount of nicotine present in the sensory precursor composition. Various additional examples of organic acids employed to produce a sensory precursor composition are described in U.S. Pat. App. Pub. No. 2015/0344456 to Dull et al., which is incorporated herein in its entirety by reference.

In another aspect, the sensory precursor composition may be of solid form and may include a plurality of microcapsules, beads, granules, and/or the like. For example, a representative microcapsule may be generally spherical in shape, and may have an outer cover or shell that contains a liquid center region of a tobacco-derived extract and/or the like.

Representative types of capsules are of the type commercially available as "Momints" by Yosha! Enterprises, Inc. and "Ice Breakers Liquid Ice" from The Hershey Company. Representative types of capsules also have been incorporated in chewing gum, such as the type of gum marketed under the tradename "Cinnaburst" by Cadbury Adams USA. Representative types of capsules and components thereof also are set forth in U.S. Pat. No. 3,339,558 to Waterbury; U.S. Pat. No. 3,390,686 to Irby, Jr. et al.; U.S. Pat. No. 3,685,521 to Dock; U.S. Pat. No. 3,916,914 to Brooks et al.; U.S. Pat. No. 4,889,144 to Tateno et al. and U.S. Pat. No. 6,631,722 to MacAdam et al.; and PCT Application WO 03/009711 to Kim; which are incorporated herein by reference in their entireties. See also, the types of capsules and components thereof set forth in U.S. Pat. No. 5,223,185 to Takei et al.; U.S. Pat. No. 5,387,093 to Takei; U.S. Pat. No. 5,882,680 to Suzuki et al.; U.S. Pat. No. 6,719,933 to Nakamura et al.; U.S. Pat. No. 7,754,239 to Mane et al. and U.S. Pat. No. 6,949,256 to Fonkwe et al.; and U.S. Pat. App. Pub. Nos. 2004/0224020 to Schoenhard; 2005/0196437 to Bednarz et al. and 2005/0249676 to Scott et al.; which are incorporated herein by reference in their entireties.

In some aspects, as shown in FIG. 8, the sensory precursor delivery device 30 may include some combination of a power source 46 (e.g., an electrical power source), at least one controller 44 (e.g., means for actuating, controlling, regulating and ceasing dispensing of the sensory precursor composition, such as by controlling electrical current flow from the power source to other components of the article), and a dispensing element 38 (e.g., an aerosol dispersing apparatus, a closeable orifice, and/or the like). In some aspects, the power source 46 may be configured to provide an electrical current to at least one of the actuating element 36 and the dispensing element 38 of the sensory precursor device 30. Although illustrated as being disposed within the sensory precursor delivery device 30 in FIG. 8, the power source 46 may be disposed in either the top cover 10 or the body portion 20, and may be configured to provide an electrical current to at least one of the actuating element 36 and/or the dispensing element 38 when the sensory precursor delivery device 30 is operably engaged with the cavity 14 of the top cover 10.

According to aspects of the present disclosure, a container configured to provide a sensory precursor composition to a substrate material may incorporate a battery or other electrical power source to provide electrical current flow sufficient to provide various functionalities of the container, such as dispensing of the sensory precursor composition, powering of control systems, powering of indicators, and the like. The power source can take on various aspects. In some aspects, the power source may be configured to deliver sufficient power to rapidly heat a heating element to provide for aerosol formation of the sensory precursor composition before delivering sufficient power to a dispensing element to deliver the formed aerosol to the internal space of the container. The power source preferably is sized to fit conveniently within the container so that the container can be easily handled.

Examples of useful power sources include lithium ion batteries that preferably are rechargeable (e.g., a rechargeable lithium-manganese dioxide battery). In particular, lithium polymer batteries can be used as such batteries can provide increased safety. Other types of batteries—e.g., N50-AAA CADNICA nickel-cadmium cells—may also be used. Even further examples of batteries that can be used according to the disclosure are described in U.S. Pub. App. No. 2010/0028766 to Peckerar et al., the disclosure of which is incorporated herein by reference in its entirety. Thin film batteries may be used in certain aspects of the disclosure. Any of these batteries or combinations thereof can be used in the power source, but rechargeable batteries are preferred because of cost and disposal considerations associated with disposable batteries. In aspects wherein disposable batteries are provided, the container can include access for removal and replacement of the battery. Alternatively, in aspects where rechargeable batteries are used, the container can comprise charging contacts, for interaction with corresponding contacts in a conventional recharging unit deriving power from a standard 120-volt AC wall outlet, or other sources such as an automobile electrical system or a separate portable power supply, including USB connections. Means for recharging the battery can be provided in a portable charging case that can include, for example, a relatively larger battery unit that can provide multiple charges for the relatively smaller batteries present in the container. The article further can include components for providing a non-contact inductive recharging system such that the article can be charged without being physically connected to an external power source. Thus, the container can include components to facilitate transfer of energy from an electromagnetic field to the rechargeable battery within the container.

In some aspects, the power source also can comprise one or more capacitors. For example, the power source may include a combination of any number of batteries and/or capacitors. In some aspects, the power source may include at least one battery and at least one capacitor. Capacitors are capable of discharging more quickly than batteries and can be charged between dispensing the sensory precursor composition to the internal space, allowing the battery to discharge into the capacitor at a lower rate than if it were used to power the sensory precursor delivery device. For example, a supercapacitor—i.e., an electric double-layer capacitor (EDLC)—may be used separate from or in combination with a battery. When used alone, the supercapacitor may be recharged before each use of the container and/or sensory precursor delivery device. Thus, the disclosure also may include a charger component that can be attached to the container between uses to replenish the supercapacitor.

The container can further include a variety of power management software, hardware, and/or other electronic control components. For example, such software, hardware, and/or electronic controls can include such functionality as carrying out charging of the battery, detecting the battery charge and discharge status, performing power save operations, preventing unintentional or over-discharge of the battery, and/or the like.

According to another aspect, the actuating element 36 may be linked to controller 44 for manual control of the electrical current flow and/or for initiating the delivery of the sensory precursor composition by the dispensing element 38 to the internal space 22 of the container 5. In particular, the actuating element 36 may be configured to actuate electrical current flow to the controller 44 and/or the dispensing element 38. In some aspects, multiple buttons can be provided for manual performance of powering the sensory precursor delivery device 30 and/or for causing the dispensing unit 38 to provide the internal space 22 of the container 5 with the sensory precursor composition.

As shown in FIGS. 4A and 4B, the actuating element 36 may include a pushbutton configured to cause the storage chamber 34 to provide the internal space 22 of the container 5 with the sensory precursor composition. As shown in FIG. 8, the actuating element 36 may be configured to provide an electrical signal to the controller 44 corresponding to the actuating element 36 receiving a user input such that the controller 44 provides an electrical signal to the power source 46 and/or the dispensing element 38 to dispense the sensory precursor composition from the storage chamber 34 to the substrate material disposed within the container 5. For example, the actuating element 36 may include capacitive sensing components to allow for diverse types of "power-up" and/or "power-down" operations for one or more elements of the container.

In particular, capacitive sensing can include the use of any sensor incorporating technology based on capacitive coupling including, but not limited to, sensors that detect and/or measure proximity, position or displacement, humidity, fluid level, pressure, or acceleration. Capacitive sensing can arise from electronic components providing for surface capacitance, projected capacitance, mutual capacitance, or self-capacitance. Capacitive sensors generally can detect anything that is conductive or has a dielectric different than that of air. Capacitive sensors, for example, can replace mechanical buttons (i.e., the push-button referenced above) with capacitive alternatives. Thus, one specific application of capacitive sensing according to the disclosure is a touch capacitive sensor. For example, a touchable portion (i.e., a touch pad) can be present on the container that allows the user to input a variety of commands. Most basically, the touch pad can provide for powering the dispensing element much in the same manner as a push button, as already described above. In other aspects, capacitive sensing can be applied to any of the surfaces of the container 5 such that the presence and/or pressure applied to any of the surfaces of the container 5 can signal the container to provide power to the dispensing element 38. In addition to touch capacitance sensors, motion capacitance sensors, liquid capacitance sensors, and accelerometers can be utilized according to the disclosure to elicit a variety of response from the container. Further, photoelectric sensors also can be incorporated into the inventive container.

According to some aspects, the actuating element 36 may be mechanically engaged with the dispensing element 38 so as to provide the sensory precursor composition to the substrate material disposed within the internal space 22 of the container 5. For example, when the pushbutton is depressed, as shown in FIG. 4B, the actuating element 36 may be mechanically coupled to the dispensing element 38 such that actuation of the actuating element 36 causes the dispensing element 38 to provide the internal space 22 with the sensory precursor composition. In particular, the dispensing element 38 may include an aperture closure that is mechanically coupled to the actuating element 36 such that actuation of the actuating element 36 causes the aperture closure of the dispensing element 38 to open and provide for fluid communication between the storage chamber 34 and the internal space 22 of the container 5.

In some aspects, a user may selectively dispense a number of doses of the sensory precursor composition by actuating the pushbutton actuating element 36. In another aspect, the actuating element 36 may include a pushbutton switch whereby depressing the switch into a dispensing position, as shown in FIG. 4B, would cause the dispensing element 38 to provide the internal space 22 with the sensory precursor composition until the pushbutton switch was returned to the original position, as shown in FIG. 4A. Alternatively, the original and dispensing positions of a pushbutton switch could be reversed such that when a pushbutton switch actuating element is disposed in the original position, the pushbutton switch is flush with the outer wall 32 of the sensory precursor delivery device 30.

In some aspects, at least a portion of the storage chamber 34 and the actuating element 36 may be integrally formed with one another. As shown in FIG. 5, the portion of the storage chamber 34 integrally formed with the actuating element 36 may include a pliable portion 42 configured to deform when a mechanical force is applied thereto. In particular, the pliable actuating element 36 may be configured such that when a user depresses the pliable actuating element 36, the storage chamber 34 is deformed and the sensory precursor composition stored therein is provided to the internal space 22 of the container through the dispensing element 38.

Referring to FIGS. 6A and 6B, the sensory precursor delivery device 30 may further include a dispensing element 38 disposed proximate the outer wall 32. In some aspects, the dispensing element 38 may include an orifice configured to be in fluid communication with the delivery orifice 12 of the top cover 10. For example, according to some aspects, the orifice of the dispensing element 38 may be shaped and/or sized to correspond with the delivery orifice 12 of the top cover 10. In particular, the orifice of the dispensing element 38 may be substantially circular in shape and have a circumference substantially equal to the circumference of the substantially circular shaped delivery orifice 12 defined by the top cover, as shown in FIGS. 2 and 7. In some aspects, the dispensing element 38 may include a one-way valve (e.g., a duckbill valve) configured to allow the sensory precursor composition to flow in a single direction from the storage chamber 34 to the internal space 22 of the container 5.

In some aspects, the dispensing element 38, as shown in FIG. 6B, may include a semi-permeable material 40 configured to retain the sensory precursor composition within the storage chamber 34 until the actuating element 36 is actuated. Such materials may have the form of a mesh, screen, perforated paper, permeable fabric, or the like. In another aspect, the dispensing element 38 may include materials that undergo a controlled dispersion or dissolution upon actuating of the actuating element 36. For example, the storage chamber 34 may be divided into at least two portions where a first portion includes a dry solid material and a second portion includes a wet liquid material. Actuation of the actuating element 36 may cause the two materials of the sensory precursor composition to mix. Additionally, the dispensing element 38 may include an orifice covered with a material such as, for example rice paper and/or the like, which may dissolve when the wet liquid material of the sensory precursor composition contacts the dissolvable material of the dispensing element 38 thereby providing for fluid communication between the storage chamber 34 and the internal space 22 of the container 5. Other exemplary materials to cover an orifice of the dispensing element 38 may be manufactured using water dispersible film forming materials (e.g., binding agents such as alginates, carboxymethylcellulose, xanthan gum, pullulan, and the like), as well as those materials in combination with materials such as ground cellulosics (e.g., fine particle size wood pulp). If desired, flavoring ingredients, disintegration aids, and other desired components, may be incorporated within, or applied to, the material.

As shown in FIG. 8, the dispensing element 38 may also be configured to receive electrical current from a power source 46 so as to provide the internal space 22 of the container 5 with the sensory precursor composition. According to some aspects of the present disclosure, the dispensing element 38 may include a heating element 48 and a dispersing unit 50. In particular, the storage chamber 34 may be in fluid communication with the dispensing element 38 such that an amount of sensory precursor composition is provided to the dispensing element 38 upon actuation of the actuating element 36. According to some aspects, then the sensory precursor composition is delivered to the dispensing element 38, and before the dispensing element 38 provides the internal space 22 with the sensory precursor composition, the heating element 46 may be configured to heat the sensory precursor composition to a desired temperature. In some aspects, the heating element 46 may be configured to heat the sensory precursor composition so as to produce an aerosol of the sensory precursor composition for delivery to the internal space 22. In particular, the dispensing element 38 may include a dispersing unit 50 that is operably engaged with the delivery orifice and configured to provide a heated (i.e., an aerosolized) sensory precursor composition to the internal space 22 of the container 5. Additionally or alternatively, the dispersing unit 50 may include a micropump configured to pressurize and/or pump the heated sensory precursor composition before the aerosolized form of the sensory precursor composition is provided to the internal space 22 of the container 5.

Many modifications and other aspects of the disclosure will come to mind to one skilled in the art to which this disclosure pertains having the benefit of the teachings presented in the foregoing descriptions and the associated drawings. Therefore, it is to be understood that the disclosure is not to be limited to the specific aspects disclosed herein and that modifications and other aspects are intended to be included within the scope of the appended claims. Although specific terms are employed herein, they are used in a generic and descriptive sense only and not for purposes of limitation.

That which is claimed:

1. A container comprising:

a top cover;

a body portion configured to operably engage the top cover to substantially enclose an internal space defined by the body portion and the top cover, the internal space configured to retain a substrate material therein; and a sensory precursor delivery device configured to retain a sensory precursor composition and dispense the sensory precursor composition, on demand, to the internal space;

wherein the sensory precursor delivery device is received in a cavity defined in a top surface of the top cover, the cavity being in fluid communication with the internal space so that the sensory precursor composition is dispensable via the sensory precursor delivery device, on demand, to the internal space.

2. The container of claim 1, wherein the sensory precursor delivery device further comprises:

an outer wall defining, in part, a storage chamber configured to retain the sensory precursor composition therein;

an actuating element configured to cause the storage chamber to dispense the sensory precursor composition to the internal space of the container upon actuation; and a dispensing element disposed proximate the outer wall, the dispensing element configured to be in fluid communication with the storage chamber and to retain the sensory precursor composition within the storage chamber until actuation by the actuation element, wherein the sensory precursor delivery device is operably engaged with a delivery orifice defined by at least one of the top cover and body portion, the delivery orifice configured to provide for fluid communication between the sensory precursor delivery device and the internal space defined by the body portion and the top cover.

3. The container of claim 2, wherein the dispensing element further comprises a semi-permeable material configured to retain the sensory precursor composition within the storage chamber until actuation of the actuating element.

4. The container of claim 3, wherein the outer wall of the storage chamber is configured to deform, in response to a mechanical force applied to the actuation element, such that the sensory precursor composition stored therein is dispensed to the internal space defined by the top cover and the body portion through the dispensing element.

5. The container of claim 4, wherein at least a portion of the storage chamber includes a pliable portion, and the actuation element is integrally formed with the pliable portion.

6. The container of claim 2 further comprising a power source configured to provide an electrical current to at least one of the actuating element and the dispensing element of the sensory precursor delivery device.

7. The container of claim 6, wherein the power source is disposed within the sensory precursor delivery device.

8. The container of claim 6, wherein the dispensing element further comprises:

a heating element configured to heat the sensory precursor composition disposed within the storage chamber; and a dispersing unit operably engaged with the delivery orifice and configured to provide the heated sensory precursor composition to the internal space.

9. The container of claim 8, wherein the dispersing unit comprises a micropump for pressuring the heated sensory precursor composition, the micropump being operably engaged with the delivery orifice so as to provide the pressurized heated sensory precursor composition to the internal space.

10. The container of claim 6, wherein the top cover further defines a cavity configured to receive at least a portion of the sensory precursor delivery device therein, wherein operably engagement between the sensory precursor delivery device and the cavity provides for fluid communication between the storage chamber of the sensory precursor delivery device and the internal space of the container.

11. The container of claim 10, wherein the power source is disposed in at least one of the top cover and the body portion, the power source configured to provide an electrical current to at least one of the actuating element and the dispensing element when the sensory precursor delivery device is operably engaged with the cavity of the top cover.

12. The container of claim 1, wherein the internal space configured to retain the substrate material includes a tobacco-related material disposed therein, the tobacco-related material being configured to absorb the sensory precursor composition.

13. The container of claim 1, wherein the internal space configured to retain the substrate material includes an absorbent porous material disposed therein, the absorbent porous material being configured to absorb the sensory precursor composition.

14. The container of claim 13, wherein the internal space configured to retain the absorbent porous material includes at least one of a plant material, an organic material, a food grade polymer, and a food grade fiber disposed therein.

15. The container of claim 13, wherein the internal space configured to retain the absorbent porous material includes a microcrystalline cellulose material disposed therein.

16. The container of claim 1, wherein the sensory precursor delivery device configured to retain the sensory precursor composition includes a nicotinic compound disposed therein.

17. The container of claim 1, wherein the sensory precursor delivery device configured to retain the sensory precursor composition includes a humectant compound disposed therein.

18. The container of claim 1, wherein the sensory precursor delivery device configured to retain the sensory precursor composition includes a sensory precursor liquid disposed therein.

19. The container of claim 1, wherein the sensory precursor delivery device configured to retain the sensory precursor composition includes a solid soluble material disposed therein.

20. The container of claim 1, wherein the sensory precursor delivery device configured to retain the sensory precursor composition includes a flavoring material disposed therein, the flavoring material being configured to flavor the tobacco-related material disposed within the internal space selected from the group comprising tobacco extract, sweeteners, vanilla, coffee, tea, chocolate, cream, mint, spearmint, menthol, peppermint, wintergreen, lavender, cardamom, nutmeg, cinnamon, clove, cascarilla, sandalwood, honey, maple, jasmine, ginger, anise, sage, licorice, lemon, orange, apple, peach, lime, cherry, and strawberry.

* * * * *